United States Patent [19]

Chin

[11] Patent Number: 4,822,968

[45] Date of Patent: Apr. 18, 1989

[54] ELECTROMAGNETIC ENERGY SEAL FOR A MICROWAVE OVEN

[75] Inventor: Seok W. Chin, Busan, Rep. of Korea

[73] Assignee: Goldstar Co., Ltd., Seoul, Rep. of Korea

[21] Appl. No.: 126,254

[22] Filed: Nov. 25, 1987

[30] Foreign Application Priority Data

Nov. 29, 1986 [KR] Rep. of Korea ..... 10191/1986[U]

[51] Int. Cl.[4] ..... H05B 6/76

[52] U.S. Cl. ..... 219/10.55 D; 174/35 R

[58] Field of Search ..... 219/10.55 D, 10.55 R; 174/35 GC, 35 MS File, 35 R

[56] References Cited

U.S. PATENT DOCUMENTS 3,668,357 6/1972 Kobayashi ..... 219/10.55 D
4,475,023 10/1984 Iwabuchi et al. ..... 219/10.55 D
4,584,447 4/1986 Kusunoki et al. ..... 219/10.55 D
4,659,891 4/1987 Yamaguchi et al. ..... 219/10.55 D
4,700,034 10/1987 Lee ..... 219/10.55 D

*Primary Examiner*—Philip H. Leung
*Attorney, Agent, or Firm*—Birch, Stewart, Kolasch & Birch

[57] ABSTRACT

An electromagnetic energy seal for a microwave oven includes a seal plate fixed on an inner wall of a door frame of the oven which is adapted to form an opening. From an upper end of an outer wall of the door frame, an inwardly bent member is extended. Also, slits having a uniform width are formed in the bent member at intervals where the electric field component of the electromagnetic energy utilized by the oven is at a maximum. The use of these slits effectively interrupt the propagation of the electromagnetic energy.

3 Claims, 3 Drawing Sheets

ELECTROMAGNETIC ENERGY SEAL FOR A MICROWAVE OVEN

BACKGROUND OF THE INVENTION

1. Field of the Invention

The present invention relates to an electromagnetic energy seal for a microwave oven, and particularly to an electromagnetic energy seal for a microwave oven, which can effectively prevent the leakage of electromagnetic energy through a gap between a front plate and a door of the microwave oven.

2. Description of the Prior Art

Conventionally, a combination of a choke seal and a capacitative seal has been used, to prevent the leakage of electromagnetic energy through the gap between the front plate and the door of the microwave oven.

Referring to FIGS. 1 and 2, a conventional electromagnetic energy seal is shown, wherein a choke channel 4 is defined in the interior having a door frame 3 of a "⊔"-type cross section, which frame is disposed adjacent to the outer peripheral edge of a door 2 of a microwave oven. On the inner wall 3*a* of the door frame 3, a seal plate 6 is mounted parallel to a front plate 5 of the oven body 1 to form an opening 7 with a certain width between the door frame 3 and the seal plate 6. The width is determined such that the distance between the inner wall 3*a* of door frame 3 and the center line 7*a* of the opening 7 is $\lambda/4$ (herein, $\lambda$ is the wavelength of the electromagnetic energy adapted to heat the food). A gap 8 is formed between the front plate 5 and the seal plate 6.

In the conventional electromagnetic energy seal of the above-mentioned construction, the inner wall 3*a* of the choke channel 4 functions as a short circuit plane with respect to the electromagnetic energy being leaked outwardly through the gap 8 from the heating room of the oven, so that the impedance of the inlet 8*a* of gap 8 is very low, thereby causing the electromagnetic energy to be reflected from the inlet 8*a*.

For example, in the case of a waveguide, the impedance $Z_L$ at a certain distance d is represented as follows:

$$Z_L = jZ_O \tan(2\pi d)/\lambda$$

wherein, j is $\sqrt{-1}$ and $Z_O$ is the characteristic impedance.

In the above equation, when the distance d is $\lambda/4$, the impedance $Z_L$ goes to the infinite value. On the other hand, when the distance d is $\lambda/2$, the impedance $Z_L$ becomes 0.

Accordingly, since the distance between the inner wall 3*a* of the door frame 3 and the center line 7*a* of the opening 7 is about $\lambda/4$ and the distance between the center line 7*a* and the inlet 8*a* is about $\lambda/4$ in the above-mentioned construction, so that the distance between the inner wall 3*a* and the inlet 8*a* is about $\lambda/2$, the impedance at the inlet 8*a* becomes close to 0. As a result, the electromagnetic energy is reflected from the inlet 8*a*, so that the leakage of the electromagnetic energy through the gap 8 can be avoided. And also, the gap 8 between the front plate 5 and the seal plate 6 functions as a capacitive seal having a low impedance with respect to the electromagnetic energy, thereby preventing the leakage of the electromagnetic energy.

In such conventional electromagnetic energy seal, however, the following problems occur:

(1) When the front plate 5 and the seal plate 6 make contact with each other at the point P to form a metal-to-metal contact point, the metal-to-metal contact point P functions as a short circuit point. As a result, the impedance of the inlet 8*a* of the gap 8 can not be reduced, and thus, the choke seal can not be formed, so that the leakage of the electromagnetic energy can not be completely prevented.

(2) The above-mentioned effect of the choke seal is sharply reduced, as the width of the gap 8 increases. This may be apparent from a laboratory test. Generally, the characteristic impedance of the parallel transmission line formed by the front plate 5 and the seal plate 6 is inversly proportional to the width of the gap 8. For example, as the width of the gap 8 is increased from 50 $\mu$m to 1 mm, by 20 times, the characteristic impedance is reduced by 1/20 times, as compared with the case of 50 $\mu$m.

On the other hand, in order to prevent the generation of a spark between the seal plate 6 and the front plate 5, an insulation film with a thickness of about 50 $\mu$m is attached, or an oxide film is formed on the seal plate 6 or the front plate 5. Various dimensions including the depth of the choke channel 4 are determined by the parallel transmission line with a length of $\lambda/4$ formed by the door frame 3 and the seal plate 6. Generally, the density of the leaked electromagnetic energy is determined to be at a minimum, when the width of the gap 8 is about 50 $\mu$m and the parallel transmission line having a length of $\lambda/4$ is connected.

Therefore, even when these two $\lambda/4$ paths have different characteristic impedances, the dimensions of the choke system is determined to exhibit a maximum effect under the above-mentioned conditions. Thus, the change of the width of the gap 8 between the front plate 5 and the seal plate 6 causes the characteristic impedance of the transmission line to be changed. In order to prevent the reduction of the choke seal effect, consequently, the width of the gap 8 should be accurately and firmly maintained, when the door is mounted to the microwave oven. However, the width of the gap 8 is gradually increased, due to the looseness of the door hinge caused by the prolonged use thereof, so that the leakage of the electromagnetic energy is increased.

(3) The choke seal of the above-mentioned construction functions effectively when the electromagnetic energy enters at a right angle with respect to the choke channel 4. On the other hand, when the electromagnetic energy enters at an angle other than a right angle, for example 45°, with respect to the choke channel 4, the width-wise wavelength of the choke channel 4 becomes $\sqrt{2}\lambda$, so that the effect of the choke seal is greatly reduced. The electromagnetic energy coming into the choke channel 4 has a rectangular component and a parallel component with respect to the longitudinal direction of the choke channel 4. The choke seal cannot be effective against the parallel component of the electromagnetic energy. Consequently, the above-mentioned construction has a disadvantage in that the leakage of the electromagnetic energy coming into the choke channel 4 at an incline can not be prevented.

SUMMARY OF THE INVENTION

Therefore, an objective of the present invention is to provide an electromagnetic energy seal for a microwave oven, wherein the choke channel is provided with a tuning post adapted to generate a LC resonance and disposed at the position in which the electric field is most strong, so that the leakage of the electromagnetic energy can be effectively prevented.

In accordance with the present invention, this objective can be accomplished by inwardly bending the outer wall of the choke channel to form a bent member, determining the interval in which the electric field is most strong by depending upon the frequency of the electromagnetic energy adapted to heat the food, and partially cutting out the bent member at an area corresponding to the interval in which the electric field is most strong, thereby forming a tuning post.

BRIEF DESCRIPTION OF THE DRAWINGS

The foregoing and further objectives and advantages of the present invention will become more apparent from the following drawings, wherein.

DETAILED DESCRIPTION OF THE PREFERRED EMBODIMENT

Figure 1:
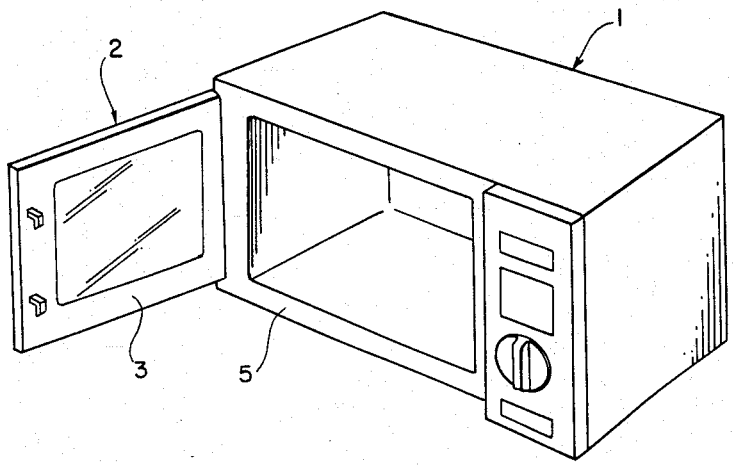
FIG. 1 is a perspective view showing a microwave oven to which the present invention is applied.
Figure 2:
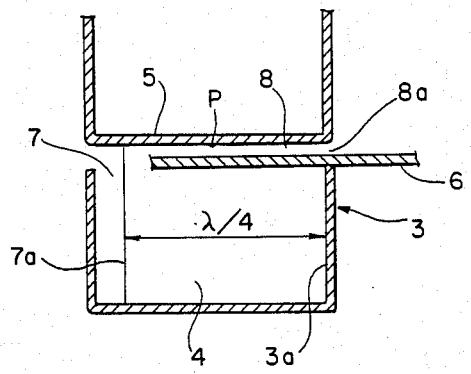
FIG. 2 PRIOR ART
FIG. 2 is a sectional view showing an electromagnetic energy seal of the prior art.
Figure 3:
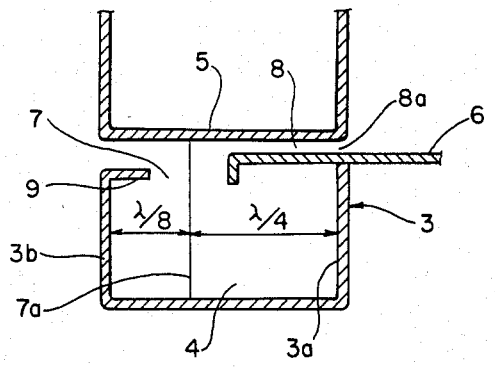
FIG. 3 is a sectional view showing an electromagnetic energy seal of the present invention.
Figure 4:
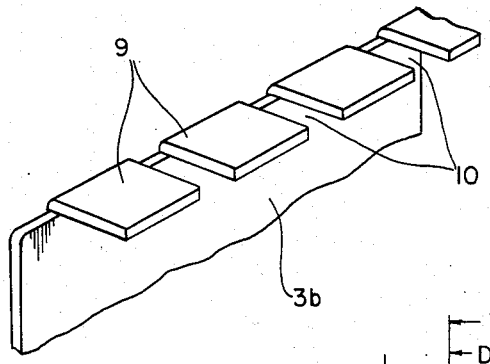
FIGS. 4 and 5 are a perspective view and a plan view showing a bent member and a slit in accordance with the present invention, respectively.
Figure 5:
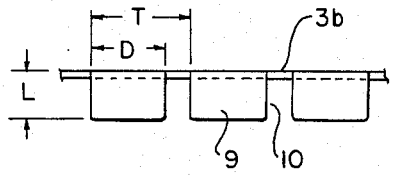

Referring to FIGS. 3 to 5, an electromagnetic energy seal, in accordance with the present invention, is shown. As shown in the drawings, the door frame 3, having a "⊔"-type cross-section is provided with a bent member 9 which extends perpendicularly from the outer wall 3*b* of the door frame 3, in accordance with the present invention. The bent member 9 is formed by inwardly bending the outer wall 3*b* of the door frame 3 toward the choke channel 4. The bent member 9 is provided with slits 10 which are formed by cutting out the bent member 9, with a uniform width, at areas in which the electric field of the electromagnetic energy is maximum. Preferably, the period interval T is less than or equal to $\lambda/4$.

Now, the function and effect of the above-mentioned construction, according to the present invention, will be described in detail.

Figure 6:
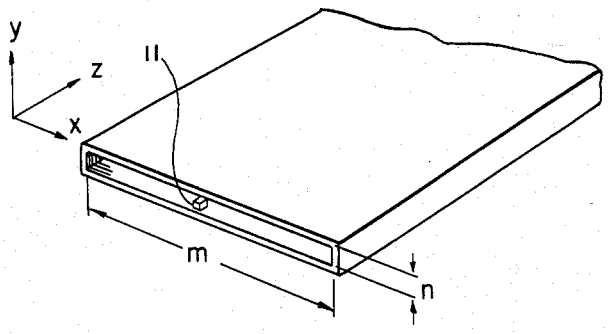
FIG. 6 is a perspective view of a wave-guide, for explaining the seal of the present invention.

FIG. 6 shows a waveguide having the width of m and the height of n, assuming $m>\lambda$ and $n<<\lambda$, if the electromagnetic energy proceeds in the Z direction, the distribution of the electric field in the Y direction is uniform, because of $n<<\lambda$.

When it is desired to determine the $TE_{mn}$ mode of the electric field distribution, and the electric field distribution is uniform in the Y direction, one only needs to determine the $TE_{mo}$ mode, that is, the mode of the electric field distribution in the direction, because n is 0.

In the $TE_{mo}$ mode, the distance for the maximum electric field point $X_{max}$ is represented as follows:

$$X_{max} = \frac{N \cdot n}{2\,m}$$

wherein N is 1, 3, 5, . . . , 2m−1.

And also, the condition under which a certain $TE_{mo}$ mode presents is $$\lambda c \geqq \lambda$$

wherein, $\lambda c$ is the cut-off wavelength of 2n/m, and $\lambda$ is a wavelength of the electromagnetic energy in a free space.

The gap 8 defined between the seal plate 6 and the front plate 5 in FIG. 3 may be assumed as the waveguide as shown in FIG. 6. When a tuning post is disposed in such waveguide as shown in FIG. 6, a LC resonance is generated between the upper surface of the tuning post 11 and the facing wall surface of the waveguide, thereby interrupting the propagation of the electromagnetic energy in the Z direction. This effect will be most effective when the tuning post 11 is disposed at the maximum electric field point.

According to this principal, the present invention provides slits which function as tuning posts 11. The interval of slits 10 can be determined experimentally as follows:

The microwave oven used in the present invention has an opening size of 299 mm×168.5 mm. For this size, the determined maximum electric field point $X_{max}$ is shown in the following table.

| m (mm) | Transmission Mode | C (mm) | $X_{max}$ |
|---|---|---|---|
| 299 | $TE_{10}$ | 598 | 149.5 |
| | $TE_{20}$ | 299 | 74.75, 224.25 |
| | $TE_{30}$ | 199.3 | 48.83, 149.5, 249.16 |
| | $TE_{40}$ | 149.5 | 37.37, 112.12, 186.87, 261.62 |
| | $TE_{50}$ | 119.6 | nothing, due to $\lambda c < \lambda$ |

wherein, the frequency of the electromagnetic energy is 2450 MHz, and the wavelength $\lambda$ is 122.45 mm.

After arranging all values for $X_{max}$, as determined above, in order, the differences between respective adjacent values are determined as follows:

$261.62-249.16=12.46\approx 12.5$
$249.16-224.25=24.91\approx 25=2\times 12.5$
$224.25-186.87=37.35\approx 37.5=3\times 12.5$
$186.87-149.5=37.37\approx 37.5=3\times 12.5$
$149.5-112.12=37.28\approx 37.5=3\times 12.5$
$112.12-74.75=37.37\approx 37.5=2\times 12.5$
$74.75-49.83=24.92\approx 25=2\times 12.5$
$49.83-37.37=12.46\approx 12.5$
$37.37-0=37.37\approx 37.5=3\times 12.5$
$299-261.62=37.38\approx 37.5=2\times 12.5$

As apparent from the above, the maximum electric field points $X_{max}$ are positioned at intervals of 12.5K mm (K is a constant). Accordingly, when slits 10 are arranged at intervals T of 12.5 mm, all of them are disposed at the maximum electric field points $X_{max}$.

For other opening sizes, the interval T of slits 10 can be calculated in the same manner. For example, the interval T of slits 10 is about 13 mm, for the opening size of 168.5 mm. The microwave oven, in which slits 10 are formed at intervals T as calculated above, greatly reduced the amount of electromagnetic energy leakage, as compared with the microwave oven in which an electromagnetic energy absorbing member is provided.

Figure 7:
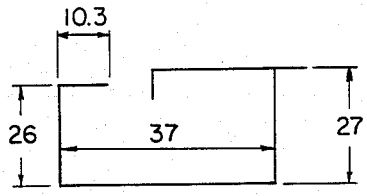
FIG. 7(A) is a schematic view showing a door frame used in the present invention.
FIG. 7(B) is a schematic view showing a door frame utilizing an electromagnetic energy absorbing material.
FIG. 7(C) is a diagram showing the comparison of the leakage amount of the electromagnetic energy between both cases of FIGS. 7(A) and 7(B).
Figure 7:
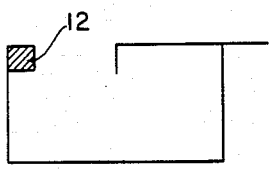
Figure 7:
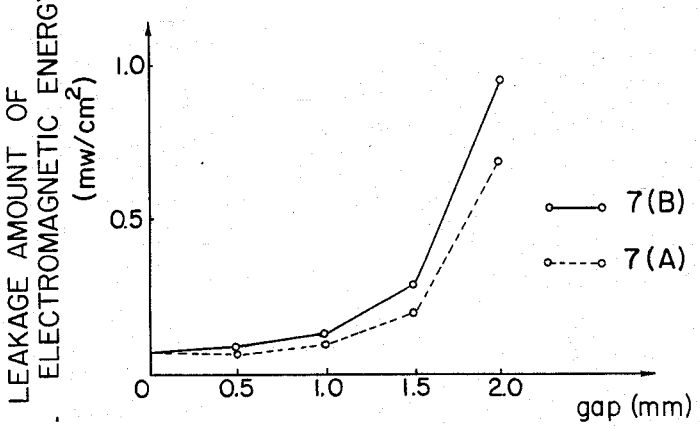

FIG. 7(A) shows detailed dimensions of the door used for the present invention. On the other hand, FIG. 7(B) shows the door having the same dimensions as in FIG. 7(A), but using the electromagnetic energy absorbing member 12 made of a ferrite. After determining the leakage of the electromagnetic energy for both cases, the result was obtained as shown in FIG. 7(C).

When the size of the heating room of the microwave oven is relatively large, the interval T of the slits 10 becomes small. However, when the interval T is very small, a difficulty in the manufacture arises. Therefore, the slits 10 are alternatively arranged by predetermining at least two large intervals. In this case, the slits 10 are non-periodically arranged, as a whole. When this interval is very large, it is impossible to cut off the leakage of the electromagnetic energy proceeding in the direction parallel to the choke channel 4. Therefore, the interval T of slits 10 should not be more than $\lambda/4$.

As apparent from the above description, the present invention effectively prevents the leakage of the electromagnetic energy, by utilizing a tuning post disposed at the position in which the electric field is most strong, thereby effectively interrupting the propagation of the electromagnetic energy. In accordance with the present invention, the necessity to use a separate electromagnetic energy absorbing member is eliminated. And also, the leakage of the electromagnetic energy which oriented rectangularly or inclinedly can be effectively cut off. In addition, the effect of the electromagnetic energy seal is not reduced when its door hinge is loosened due to the prolong use, thereby enabling the reliability of the seal to be improved.

What is claimed is:

1. An electromagnetic energy seal in combination with a microwave oven utilizing electromagnetic energy having a certain wavelength including an oven body having a front plate, a door hinged to the oven body, and a door frame having a first wall, a second wall, and a third wall, the three walls being formed perpendicular to each other to form a cross-sectional shape resembling a rectangular shape missing one of its lengths, the door frame being mounted at an outer peripheral edge of the door, said electromagnetic energy seal comprising:

seal means for preventing the electromagnetic energy of the microwave oven from leaking through the door;

said seal means including, a seal plate fixed to the first wall of the door frame and disposed substantially parallel to the front plate of the oven body and substantially parallel to the second wall of the door frame to form an opening for a cavity created by the three walls of the door frame and said seal plate, said opening having a center, said center and the first wall being spaced apart at a distance of one-quarter of the microwave oven's wavelength, said center and the third wall being spaced apart at a distance of one-eighth of the oven's wavelength, and a bent member extending perpendicular from the third wall of the door frame and parallel to the second wall of the door frame in a direction towards the first wall of the door frame, said bent member having slits with uniform width, said slits being formed at points where the electromagnetic energy's electric field component is at a maximum strength.

2. The electromagnetic seal, as claimed in claim 1, wherein an interval between said slits is no greater than one-quarter of the microwave oven's wavelength.

3. The electromagnetic energy seal, as claim in claim 1, wherein said bent member has a width less than one-thirty-second of the microwave oven's wavelength and no greater than one-eighth of the microwave oven's wavelength.

* * * * *